United States Patent [19]

Giacomelli

[11] Patent Number: 4,913,294

[45] Date of Patent: Apr. 3, 1990

[54] OPENING ARRANGEMENT FOR PACKING CONTAINERS

[75] Inventor: Peter Giacomelli, Lund, Sweden

[73] Assignee: Aktiebolaget Profor, Lund, Sweden

[21] Appl. No.: 260,074

[22] Filed: Oct. 20, 1988

[51] Int. Cl.[4] ..... B65D 5/54

[52] U.S. Cl. ..... 206/621.6; 206/626; 206/628; 220/269; 229/160.2

[58] Field of Search ..... 229/123.2, 123.3, 125.11, 229/125.42, 160.2; 206/621.6, 626, 628, 603; 220/269; 222/541, 544, 545, 571, 572

[56] References Cited

U.S. PATENT DOCUMENTS

| | | | |
|---|---|---|---|
| 1,944,058 | 1/1934 | Barnes et al. | 222/544 |
| 3,084,835 | 4/1963 | Walsh | 222/541 |
| 3,946,896 | 3/1976 | Lemelson | 206/628 |
| 4,096,967 | 6/1978 | Kamiski | 220/269 |
| 4,533,063 | 8/1985 | Buchner et al. | 229/123.2 |
| 4,576,305 | 3/1986 | Saunders | 220/269 |
| 4,798,295 | 1/1989 | Rausing | 229/160.2 |

FOREIGN PATENT DOCUMENTS

| | | | |
|---|---|---|---|
| 2303859 | 8/1973 | Fed. Rep. of Germany | 220/269 |

*Primary Examiner*—Gary Elkins

*Attorney, Agent, or Firm*—Burns, Doane, Swecker & Mathis

[57] ABSTRACT

Opening arrangements for packing containers of the type which comprise a tearing or pulling device applied to the outside of the packing container are known. By means of the pulling device a part of the wall material of the packing container can be removed so that a pouring opening is generated. To prevent the packing laminate from delaminating on opening, so that only the outer layer accompanies the pulling device, it is proposed in accordance with the invention to design the opening part so that a penetrating part is first thrust downwards through the laminate, whereupon the opening part with the pentrating part and the underlying, breached part of the packing laminate is lifted upwards so that a pouring opening is generated.

6 Claims, 2 Drawing Sheets

OPENING ARRANGEMENT FOR PACKING CONTAINERS

BACKGROUND OF THE INVENTION

The present invention relates to opening arrangements for packing containers, and, more particularly to flexible laminated containers for liquid foods that have a sealed pouring opening.

Packing containers of the non-returnable type for liquid foods or other liquid or pumpable products are made in general of a flexible packing laminate, which comprises layers of fibrous material or thermoplastic material and possibly aluminium foil. The packing laminate is converted to an individual packing container by folding and heat-sealing, and is provided, among other things also with some type of applied opening arrangement. Usually, though, the opening arrangement is constituted of cutting or tearing indications which can be printed onto the outside of the packing laminate to facilitate the removal of a suitable part of the packing container, e.g. a corner. It is also possible to use one of the seals of the packing container as an opening arrangement, the seal being broken on opening and an emergent part of the packing container being able to serve as a pouring spout.

The abovementioned known arrangements and methods for the opening of packing containers of laminated packing material all have more or less serious disadvantages. It is generally desirable for opening arrangements that they should be openable without the help of tools, that after the opening they should present a pouring opening with a smooth and well-defined edge, that the pouring opening should allow pouring out of the liquid contents in a uniform and collected jet, and that the pouring opening should be reclosable. Since the packing laminate is flexible and relatively tough, it is difficult to provide an opening arrangement which in a satisfactory manner meets all the abovementioned requirements. It has been found to be particularly difficult, for example, to provide an opening arrangement applied to the outside of the packing container which makes it possible, without major expenditure of force, to breach the packing laminate so that a pouring opening is generated, since the laminate is flexible and tough and the tearing of holes in it is difficult. It is possible, of course, to provide already during the manufacture of the packing laminate a pouring opening, which subsequently is covered with an appropriately designed external opening device, but such an arrangement is unsuitable on aseptic types of packing containers, since owing to the inclusion of a hole in the packing laminate continuous sterility cannot be guaranteed.

SUMMARY OF THE INVENTION

It is an object of the present invention to provide an opening arrangement for packing containers of flexible laminate material, such an opening arrangement being capable of being applied to the outside of the packing container and being used for breaching in a simple and supple manner a predetermined part of the packing laminate so that a pouring opening can be included in the same.

It is a further object of the present invention to provide an opening arrangement which makes it possible without major expenditure of force to breach the packing laminate, even if it consists of flexible and relatively tough material.

It is a further object of the present invention to provide an opening arrangement which is suitable for use on packing containers of the aseptic type.

The abovementioned, and other, objectives have been achieved in accordance with the invention in that an opening arrangement is attached to the outside of the packaging container and comprises a connecting part and an opening part which has two lever arms, one of which constitutes a penetrating part situated with its free end over a part of a weakening provided in the wall material of the packing container which defines an openable pouring opening, whereas the other lever arm constitutes a handling part which is several times longer than the penetrating part. The opening part is joined to the connecting part by means of a weakening serving as a hinge, on either side of which are situated the said lever arms, the connecting part as well as the penetrating part being firmly attached to the underlying, openable part of wall material of the packing container.

Preferred embodiments of the opening arrangement in accordance with the invention have been given, moreover, the characterictsics which are evident from the subsidiary claims.

DESCRIPTION OF THE DRAWINGS

Preferred embodiments of the opening arrangement in accordance with the invention will now be described in greater detail with special reference to the enclosed drawings which only show the details indispensable for an understanding of the invention.

DETAILED DESCRIPTION

The opening arrangement in accordance with the invention, as mentioned previously, is intended to be used on packing containers of the non-returnable type. These containers are manufactured from laminated material which is flexible and relatively tough and therefore difficult to breach by means of known opening arrangements, especially if the opening arrangement is placed so on the top of the packing container that sealing joints or the like cannot be used when the opening or tearing up of the material is to be initiated. To make possible the use of the opening arrangement in accordance with the invention also on packing containers of the aseptic type, that is to say packing containers with a sterile inner space which is delimited by an unbroken barrier layer, the opening arrangement is intended to be applied to the outside of the packing laminate after forming and filling of the packing container and to allow opening of the packing container without its barrier layer having been broken or weakened in advance. The opening arrangement in accordance with the invention is particularly suitable for packing containers which are manufactured from a packing laminate comprising a carrier layer of fibrous material, e.g. paper, which is covered on both sides by homogeneous layers of thermoplastic material and comprises on its side facing the contents a barrier layer of aluminium foil and a further cover layer of thermoplastic material facing towards the contents. To facilitate the breaching of the material on opening of the packing container, the carrier layer, and possibly the outer thermoplastic layer, can be wholly or partly punched through, whilst the barrier layer and the internal layer are completely unbroken.

Figure 1:
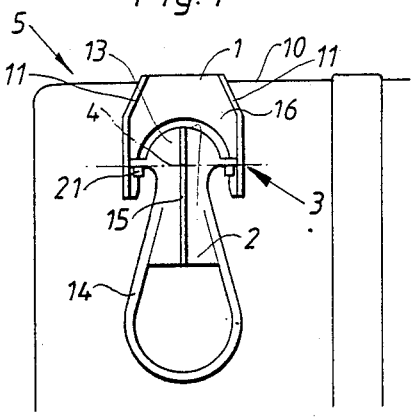
FIG. 1 is a top plan view of a first embodiment of the opening arrangement in accordance with the invention.
Figure 6:
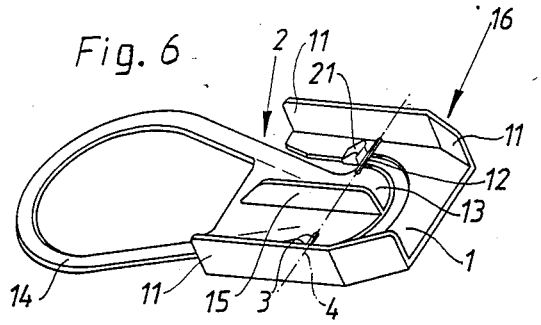
FIG. 6 is a perspective view of the first embodiment of the opening arrangement in accordance with the invention.

A first embodiment of the opening arrangement in accordance with the invention is shown from above in FIG. 1 and in perspective in FIG. 6, and comprises a connecting part 16, attached to the outside surface of the packing material, with a pouring edge 1 and an opening part 2. The connecting part 16 and the opening part 2 are joined to one another by means of a hinge 3, whose pivot axis 4 is perpendicular to the longitudinal direction of the opening part 2 and parallel with the underlying surface of the packing container 5, to which the opening arrangement in accordance with the invention is attached.

The packing container 5, as mentioned previously, may be of known type and the opening arrangement is attached by heat-sealing or with the help of so-called hot-melt to the plane top of the packing container at an appropriate place prepared to receive a pouring opening.

Figure 2:
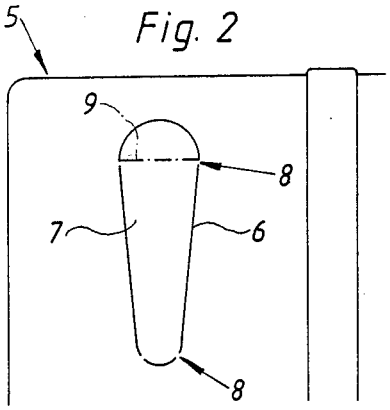
FIG. 2 is a top plan view as in FIG. 1, but showing the a pattern of weakening lines for the formation of a pouring opening on the opening arrangement in accordance with the invention.
Figure 3:
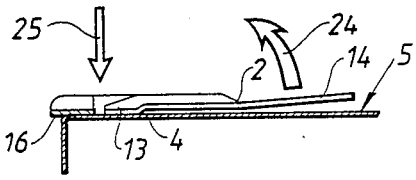
FIG. 3 is a side elevational view, partly in section of the opening arrangement in accordance with FIG. 1.

The prepared pouring opening shown in FIG. 2 comprises a weakening line 6 which may be a perforation or a cut through the carrier layer and possibly also through the outer thermoplastic layer of the packing laminate. However, the weakening line leaves the barrier layer (e.g. aluminium foil) and the internal thermoplastic layer of the packing laminate intact, and the weakening line, therefore, does not bring about any risk of leakage or of damage to the barrier layer, and thereby to the sterility of the packing container occurring. The weakening line 6 is of a form which has been found suitable for pouring openings for liquid contents, and in order to facilitate the manufacture of the packing laminate, especially the application of thermoplastic and barrier layers, the "punched out" waste piece 7 is left behind in the pouring opening. The waste piece 7 is retained in the pouring opening with the help of small bridges 8 which are formed through interruptions in the weakening line 6. The waste piece 7 is provided at its front end seen in the direction of pouring with a transverse crease line 9 which is intended to facilitate the opening, as will be explained in more detail in the following.

The opening arrangement in accordance with the invention is placed so on the upper surface of the packing container 5 that it covers the weakening line 6. At the front end of the opening arrangement the pouring edge 1 is sealed to the top of the packing container in such a position that its end remote from the pouring opening extends slightly out over an edge 10 delimiting the top of the packing container 5. So as to guide, after the opening of the packing container, the contents flowing out through the pouring opening in a collected jet over this edge, the pouring edge 1 also comprises upright, substantially parallel lateral edges 11 which prevent the contents from flowing out over the upper surface of the packing container, but instead direct them out over the edge 10.

In the first embodiment (FIG. 2–6) of the opening arrangement in accordance with the invention the pouring edge part 1 is substantially U-shaped and is situated so between the future pouring opening and the edge 10 of the packing container, that the legs of the U-shaped part embrace the front end of the pouring opening facing towards the edge 10. In the second embodiment of the opening arrangement in accordance with the invention (FIG. 7, 8) the pouring edge part 1 has a U-shaped portion placed in corresponding manner wherein, however, the legs are lengthened so that they extend along the whole length of the future pouring opening (or the weakening line 6) so as to meet at the rear end of the pouring opening and there form a reclosing arrangement.

In the first embodiment of the opening arrangement in accordance with the invention (FIG. 1, 6) the hinge 3 is constituted of two breakable pins 12, which extend in line with each other along the pivot axis 4 of the hinge and connect the opening part 2 to the two legs of the pouring edge part 1. The pivot axis 4 divides the opening part 2 into two oppositely directed lever arms, one of which constitutes a penetrating part 13, whose free end is located between the legs of the U-shaped fixed part 1 and straight over a part of the weakening line 6. The free contour of the end of the penetrating part 13 coincides preferably with a corresponding portion of the weakening line 6, and the crease line 9 dividing the waste piece 7 coincides with the pivot axis 4 of the hinge 3. The opposite lever arm of the opening part 2 forms a handling part 14, whose length is several times greater than the penetrating part 13, preferably 4–10 times longer. The two lever arms of the opening part 2 thus are oppositely directed and situated in the same plane, which is ensured with the help of a straight longitudinal stiffening 15 extending centrally along the opening part 2 and at a right angle to the pivot axis 4. The handling part 14 may be provided at its rear end with a loop to facilitate maneuvering by means of a finger.

In the second embodiment of the opening arrangement in accordance with the invention (FIG. 7 and 8) a direct connection between the opening part 2 and the pouring edge part 1 is missing. In this embodiment the opening part 2 is attached instead to a connecting part 16 comprising two parallel tongues **16*a*, 16*b*, which extend between the pivot axis 4 on the opening part 2 and backwards from the pouring edge 1. The connecting part 16 is delimited from the opening part by means of a transverse weakening line 17 which coincides with the pivot axis 4 of the hinge 3. The two tongues 16*a*, 16*b*, of the connecting part 16 are delimited besides from the pouring edge part 1 as well as from the opening part 2 with the help of a slot of 1–3 mm width which, apart from a portion along the opening part 2, extends around the penetrating part 13 and the connecting part 16 in such a manner that it largely coincides with the underlying weakening line 6 (this is true correspondingly also for the first embodiment of the arrangement in accordance with the invention where, however, the slot is delimited by the two pins 12 and thus only runs along the weakening line 6 around the free edge lines of the penetrating part 13**). Various details from the two preferred embodiments of the opening arrangement in accordance with the invention may also be combined, of course, in any manner that appears appropriate.

Figure 7:
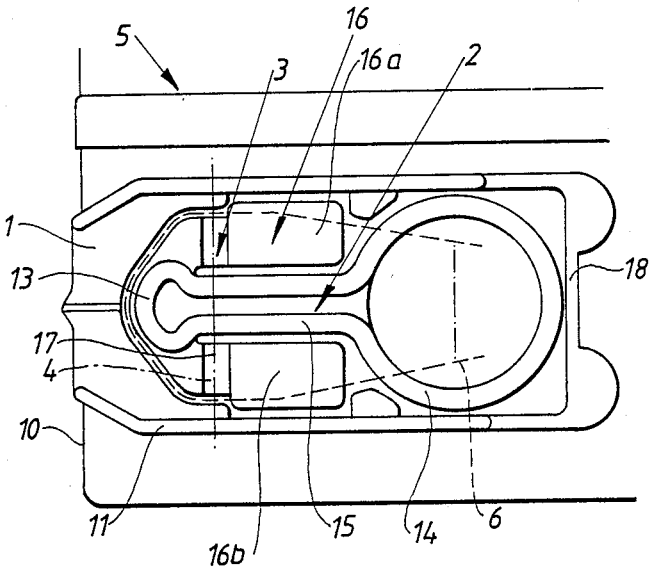
FIG. 7 is a top plan view of a second embodiment of the opening arrangement in accordance with the invention applied to the top of a packing container of known type.
Figure 8:
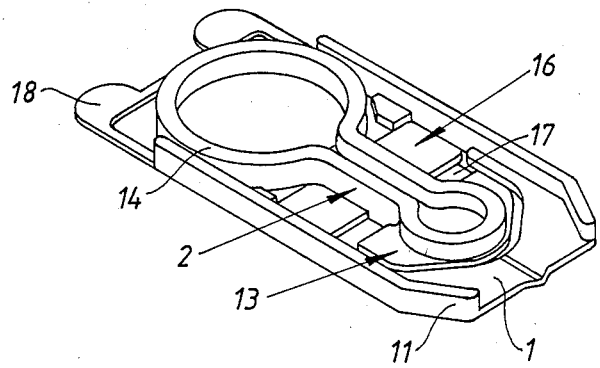
FIG. 8 is a perspective view of the second embodiment of the opening arrangement in accordance with the invention.

As is evident, especially from FIGS. 7 and 8, in the second embodiment of the arrangement in accordance with the invention too the opening part 2 consists of a front penetrating part 13 and a rear handling part 14. The penetrating part 13 in both embodiments is sealed firmly to the top of the underlying packing laminate, but in the second embodiment the connecting part 16 is also attached to the top of the packing laminate (or, more particularly, the top of the part of the packing laminate which is delimited by the weakening line 6). In this embodiment too the handling part 14 of the opening part 2 is provided with a finger opening.

The reclosing of the opening arrangement after opening can be achieved in that the waste piece 7, torn off in connection with the opening, is lowered back into the pouring opening together with the penetrating part 13 of the opening part 2 (and in the second embodiment also the connecting part 16). The lowered waste piece 7 is retained in the pouring opening with the help of an arrangement for reclosure which comprises two co-operating elements provided on the opening part 2 and on the fixed part 1 respectively and which in the first-mentioned embodiment are constituted of hooks 21 which extend up from the fixed part 1 directly behind the pins 12. The pins 12 are provided with a weakening located adjacent to the fixed part 1, so that on manoeuvring of the opening arrangement to the position shown in FIG. 4 they come loose from the fixed part 1, but stay in the form of oppositely directed projections on the opening part 2. When the opening arrangement is closed again the pins 12 are retained in the reclosing position by the two hooks 21, so that the waste piece 7 is held down in the pouring opening. In the second embodiment of the opening arrangement in accordance with the invention the legs of the pouring edge 1 extending backwards take the form of a transverse reclosing device 18 which is adapted to co-operate with the rear end of the handling part 14 of the opening arrangement 2. On reclosing of this second embodiment of the opening arrangement the waste piece 7 is returned into the pouring opening until the parts of the connecting part 16 extending slightly outside the weakening line 6 come to lie against the packing material, whereafter the transverse reclosing device 18 is lifted up and turned over the rear end of the handling part 14.

When an opening arrangement in accordance with the invention, which is mounted on a packing container of known type, is to be used for breaching the packing laminate and providing a pouring opening, the consumer takes hold of the handling part of the opening part, e.g. by sticking a finger into the opening intended for the purpose at the rear end of the manoeuvring part 14. Subsequently the handling part 14 is raised in the direction of the arrow 24 (FIG. 3), which implies that the opening part 2 will be turned round the pivot axis 4 so that its front penetrating part 13 is moved downwards, which is indicated by means of the arrow 25 in FIG. 3. Since the handling part 14 is appreciably longer than the penetrating part 13, the force exerted upon the handling part 14 will be multiplied, so that the front end of the penetrating part 13 is thrust downwards against the material with a considerable force. Surrounding parts of the packing laminate, as mentioned previously, are attached to the underside of the fixed part 1 and are prevented, therefore, from being pressed down, which means that the downwards-directed force of the penetrating part 13 will be concentrated on the front end of the penetrating part 13, that is to say the front end of the gap between the penetrating part 13 and the fixed part 1 and a corresponding portion of the weakening line 6. This means that the force will be concentrated on the weakened part of the packing material, so that this is breached releatively easily in spite of the force exerted upon the handling part 14 being small.

Figure 4:
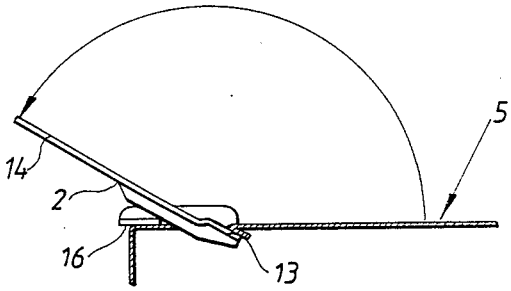
FIG. 4 is a side elevational view, partly in section, of the opening arrangement as in FIG. 3, but showing pivoting of the handling part.
Figure 5:
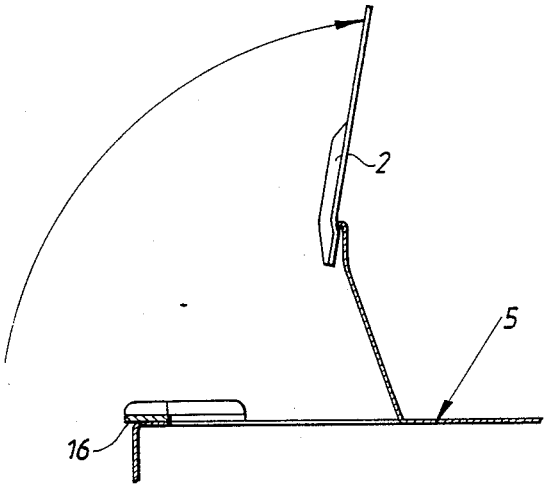
FIG. 5 is a side elevational view, partly in section, of the opening arrangement as in FIG. 4, but showing formation of the pouring opening.

Under the effect of the force, indicated by means of the arrow 24, the opening part 12 will be turned round the pivot axis 4 as indicated in FIG. 4 so that the penetrating part 13 pushes down through the packing laminate and is turned inwards into the packing container. In the first embodiment of the arrangement in accordance with the invention, as a result of this turning movement, the two pins 12 will rupture in their weakened region situated adjacent to the fixed part 1, so that the connection of the penetrating part 13 with the fixed part 1 is broken. A continued tractive force directed upwards on the handling part 14, therefore, will cause the penetrating part 13 attached to the waste piece 7 in front of the crease line 9 to lift the front end of the waste piece 7 so that the weakening line 6 continues to rupture until the waste bit 7 has been wholly or partly removed from surrounding parts of the packing container, as shown in FIG. 5. The contents now can be emptied through the pouring opening, the fixed part 1 which stays in position guiding with the help of the lateral edges 11 the flow of contents so that it passes in a collected, concentrated jet over the edge 10 of the packing container. If after completed pouring out of the contents it is desired to reclose the packing container, the waste piece 7 is returned to its original position with the help of the opening part 2 whose penetrating part 13 is led down into the space between the two legs of the U-shaped fixed part 1 and the handling part is lowered to its original position shown in FIG. 3.

The opening process in the second embodiment of the opening arrangement in accordance with the invention of a similar kind to the opening process in the first embodiment.

When the handling part 14 is raised, the penetrating part 13 will thus be turned downwards with its front end round the pivot axis 4 of the hinge 3 until the packing material ruptures along a corresponding part of the weakening line 6 and is folded downwards, with the crease line 9 serving as a hinge. When the handling part 14 has reached a substantially vertical position in relation to the top of the packing container the opening part 2 together with the connecting part 16 can be lifted upwards, as is shown in FIG. 5, the remaining parts of the weakening line 6 rupturing so that the pouring opening is uncovered. The opening part 2 continues to be attached, however, to the connecting part 16, and the reclosure of the pouring opening can take place, therefore, simply in that the waste piece 7 is guided down again into the pouring opening and the handling part 14 is pressed back into a plane with the top of the packing container, until the sideways projecting parts of the two tongues **16*a*, 16*b* come to lie against the packing material outside the weakening line 6 (that is to say against the edge of the pouring opening). The transverse reclosing device 18 now may be lifted and snapped over the rear end of the handling part 14, which holds down the opening part 2 and the waste piece 7** attached to it in a plane position indicating the pouring opening.

The opening arrangement in accordance with the invention operates according to a new principle which entails that a part of the weakened, openable portion of the packing material at the start of the opening process is thrust downwards into the packing container instead of being raised upwards, which previously has been the case in this type of packing container. The disadvantage of the raising upwards becomes obvious if one considers that the packing material is a laminate which, when it is subjected to a tractive force at a right angle to the material surface, easily delaminates, so that only the top layer or layers will follow up, whereas the remaining layers are left behind, so that the packing container remains closed. This difficulty, which previously could not be overcome, has now been completely eliminated in that the opening process is initiated by pressing the material downwards into the packing container, to be raised upwards only after the material has started to rupture. The reclosure of both the opening arrangements has been found to function well, although the second embodiment of the opening arrangement in accordance with the invention is somewhat easier to close, since the continued connection between the opening part 2 and the packing container via the relatively stiff connecting part 16 assists in guiding the waste piece 7 back to a correct position in the pouring opening.

What is claimed is:

1. A packing container of the type having a flexible wall of packaging material comprising an opening arrangement, means securing the opening arrangement on an exterior surface of said flexible wall, said opening arrangement having at least two lever arms extending an opposite sides of a hinge, one of said at least two lever arms being a handling part and the other of said at least two lever arms being a penetrating part, and said wall having a weakening line, whereby raising the handling part from said wall presses the penetrating part into the wall to sever the wall along the weakening line to form a pouring opening, said arrangement including a pouring edge part adjacent said weakening line and means for reclosure supported by the pouring edge part and adapted for positive engagement with the handling part.

2. An opening arrangement in accordance with claim 1, wherein the hinge is situated parallel with, and directly above, a folding line formed in the underlying wall of the packing container.

3. An opening arrangement in accordance with claim 1, wherein the opening arrangement further includes a connecting part having two tongues which extend substantially parallel along the handling part, and are separated from the penetrating part by means of the hinge.

4. An opening arrangement in accordance with claim 3, wherein the tongues extend slightly outside the weakening line provided in the wall material.

5. An opening arrangement in accordance with claim 1, wherein the penetrating part is surrounded by a U-shaped pouring edge part, the distance between the two parts amounting to between 1 and 3 mm.

6. An opening arrangement in accordance with claim 5, wherein the pouring edge part comprises devices for the guidance of the contents pouring out from the packing container.

* * * * *